US007047680B2

(12) United States Patent
Myles

(10) Patent No.: US 7,047,680 B2
(45) Date of Patent: May 23, 2006

(54) VEHICLE ALERT KIT

(76) Inventor: David R. Myles, 5910 University St., Detroit, MI (US) 48224

( * ) Notice: Subject to any disclaimer, the term of this patent is extended or adjusted under 35 U.S.C. 154(b) by 128 days.

(21) Appl. No.: 10/798,501

(22) Filed: Mar. 12, 2004

(65) Prior Publication Data

US 2005/0204599 A1 Sep. 22, 2005

(51) Int. Cl.
*G09F 17/00* (2006.01)
*G09F 21/04* (2006.01)
*G09F 3/16* (2006.01)

(52) U.S. Cl. ..... 40/607.1; 40/591; 40/607.14; 116/173

(58) Field of Classification Search ..... 40/591, 40/592, 600, 610, 607.1, 607.02, 607.14, 40/666, 607.12; 116/173; 248/534, 535, 248/536, 214, 229.13, 229.16, 227.2, 228.4, 248/231.51, 231.8
See application file for complete search history.

(56) References Cited

U.S. PATENT DOCUMENTS 2,025,004 A * 12/1935 Shearer ..... 40/607.04
3,119,370 A * 1/1964 Keats ..... 116/173
3,148,856 A * 9/1964 Orlando ..... 248/205.6
3,477,161 A * 11/1969 Drexler ..... 40/218
4,144,833 A 3/1979 Newman, Sr.
4,574,726 A 3/1986 Sullivan
5,226,792 A 7/1993 Darago
D349,870 S 8/1994 Willis et al.
5,388,359 A * 2/1995 DeWitt ..... 40/607.14
5,685,255 A 11/1997 Arzu
5,878,519 A * 3/1999 Huyck et al. ..... 40/612
D427,108 S 6/2000 Fisher et al.
6,112,443 A 9/2000 Stubbs

* cited by examiner

*Primary Examiner*—Brian K. Green

(57) ABSTRACT

A vehicle alert kit includes at least one base member having a substantially planar bottom surface and a threaded portion integral therewith. The kit further includes a mechanism for fastening at least one base member to a surface so that same can be maintained at a substantially secure position. The kit further includes an elongated support member having a lower end portion threadably attachable to a select one of at least one base member. The elongated support member extends substantially vertically and upwardly from the base member to a predetermined height, and includes a receiving portion extending substantially vertically along a length thereof and having a bottom surface. The kit further includes a flag having indicia printed thereon and including an edge portion selectively engageable with the receiving portion.

9 Claims, 5 Drawing Sheets

VEHICLE ALERT KIT

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to emergency signaling devices and, more particularly, to a vehicle alert kit for notifying passing motorists of the need for assistance.

2. Prior Art

The use of signage to indicate the condition of a stationary vehicle is well known in the art. On seeing the sign, it is hoped that a passing motorist will summon an appropriate emergency response. It would be helpful if the passing motorist knew what type of assistance was needed, if any, and could then summon such assistance to the disabled stationary vehicle.

The prior art discloses structures and methods for a person to display signage proximate a disabled stationary vehicle that encourages a passing motorist to summon an emergency response. Unfortunately, the people in the passing cars who observe the stationary vehicle have no way of knowing what type of emergency response is desired, if any. The observers in the passing cars may assume help is needed and stop to offer personal assistance or call the authorities for a professional emergency response even if none is needed or help has already been summoned. Also, if an observer in good faith calls for assistance, the emergency response system is unnecessarily burdened if the observer calls for assistance that is not required or desired.

In another example, a vehicle becomes disabled and the driver desires assistance. Using prior art signage the driver may indicate that assistance is needed and therefore passing motorists may summon a professional emergency response. It is even likely on a busy road that several drivers will make calls to summon an emergency response. Further, in some circumstances, a passing motorist may, in good faith, stop and offer personal assistance. Indeed, the driver with the disabled vehicle may become aware that an emergency response has already been requested or find that an emergency response is no longer needed. However, those vehicles passing by will not know that an emergency response has already been requested and may therefore continue to call 911 or other emergency number for requesting an emergency response. Another problem is that the motorist who is stopping to help has increased the chance of accident or mishap by entering and exiting the active travel lanes.

Thus, it would be highly desirable to have a new and improved device and method that communicates the type of assistance required, if any, and would not cause the emergency response communication system to become clogged with unnecessary calls. Additionally, such a device and method should not cause disruption to the normal flow of traffic.

Accordingly, a need remains for a vehicle alert kit that notifies passing motorists of the type of assistance needed.

BRIEF SUMMARY OF THE INVENTION

In view of the foregoing background, it is therefore an object of the present invention to provide a device for alerting passing motorists that assistance is needed. These and other objects, features, and advantages of the invention are provided by a vehicle alert kit including at least one base member having a substantially planar bottom surface for resting on a surface. At least one base member has a centrally disposed axis traversing therethrough and further has a threaded opening centered about the axis.

The kit further includes a mechanism for fastening at least one base member to a surface so that such a base member can be maintained at a substantially secure position. In a preferred embodiment, the fastening mechanism preferably includes a magnet secured to the bottom surface of at least one base member. In an alternate embodiment, the fastening mechanism preferably includes an elongated anchor member having a substantially rectangular shape and including a threaded fastening member extending upwardly therefrom and being securable to the at least one base member.

The anchor member further includes a plurality of arms extending outwardly and downwardly from the anchor member and for gripping a support structure therebetween. Such a plurality of arms are pivotal between engaged and disengaged positions. A plurality of support members are also pivotally connected to opposed end portions of the anchor member. Such a plurality of support members include a plurality of hinges connected thereto and for allowing the plurality of support members to be moved between folded and extended positions.

The kit further includes an elongated support member having a lower end portion threadably attachable to a select one of the base members. The elongated support member extends substantially vertically and upwardly from the base member to a predetermined height, and includes a receiving portion extending substantially vertically along a length thereof and having a bottom surface.

The kit further includes a flag having indicia printed thereon and an edge portion selectively engageable with the receiving portion. The receiving portion is positionable on the bottom surface thereof so that the flag can be maintained in a substantially stable position. The edge portion is positionable within the receiving portion in a substantially vertical direction and substantially parallel to the axis. The receiving portion is integral with the support members 20 and extends outwardly therefrom, and further has a groove for allowing the flag to be selectively positioned along a length thereof. The receiving portion further includes a plurality of arcuate portions integral with the support members 20, which converge outwardly therefrom. The flag extends outwardly and away from the support members 20 when the edge portion is disposed within the receiving portion.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
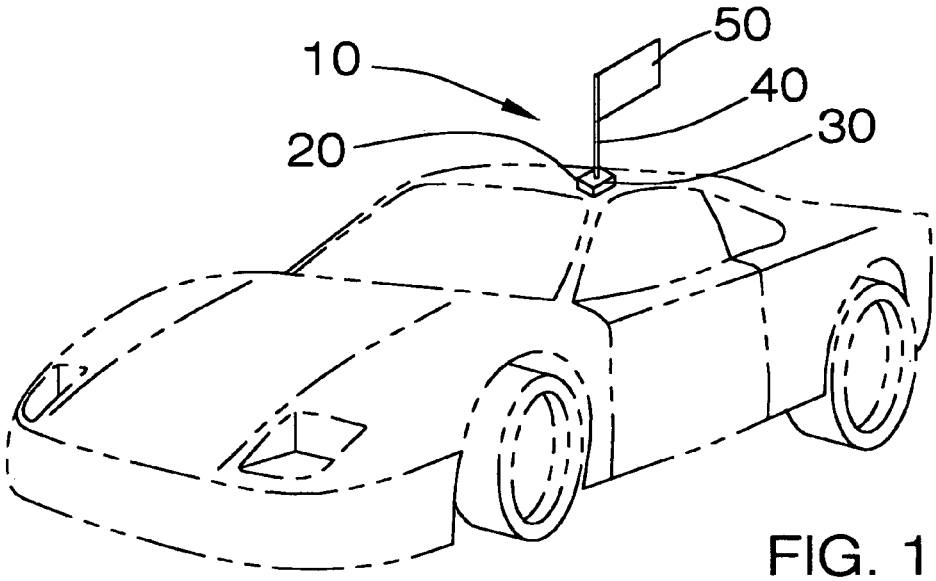
FIG. 1 is a perspective view showing a vehicle alert kit in a preferred environment, in accordance with the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements throughout and prime and double prime numbers refer to alternate embodiments of such elements.

The device of this invention is referred to generally in FIGS. 1–6 by the reference numeral 10 and is intended to provide a vehicle alert kit for notifying passing motorists of the need for assistance. It should be understood that the kit 10 may be used to convey many different types of messages and should not be limited to only messages alerting others of the need for assistance.

Figure 2:
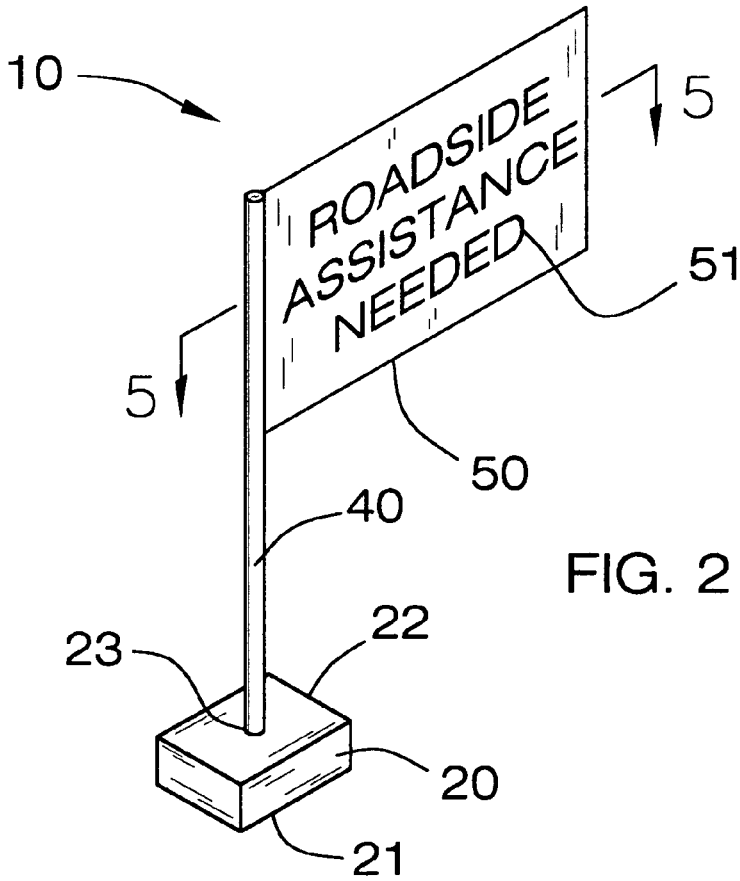
FIG. 2 is an enlarged, perspective view of the present invention.
Figure 3:
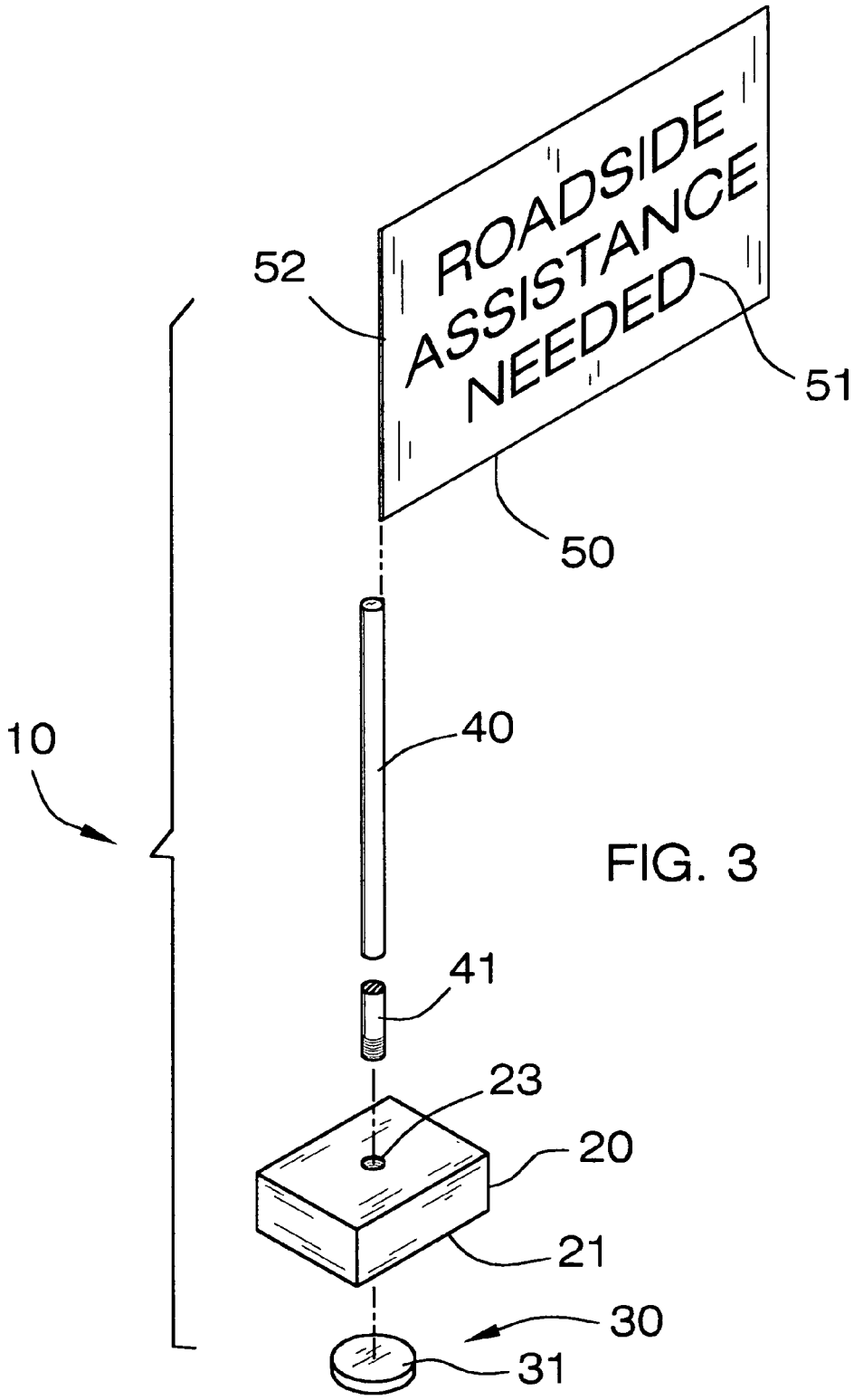
FIG. 3 is an enlarged, exploded view of FIG. 2.

Initially referring to FIGS. 2 and 3, the kit 10 includes at least one base member 20 having a substantially planar bottom surface 21 for resting on a surface. The base member 20 has a centrally disposed axis 22 traversing therethrough and further has a threaded opening 23 centered about the axis 22.

The kit 10 further includes a mechanism 30 for fastening at least one base member 20 to a surface so that same can be maintained at a substantially secure position, as perhaps best shown in FIG. 1. The fastening mechanism 30 includes a magnet 31 secured to the bottom surface 21 of the base member 20, as perhaps best shown in FIG. 3. This enables a user to securely mount the kit 10 on a metallic surface, like the roof of an automobile, for example, where it would be visible to passing motorists. It also allows a user to easily detach the kit 10 when no longer needed. Advantageously, the weight of the magnet adds stability to the base member 20 in assisting same to remain upright in windy conditions and to better absorb the buffeting caused by passing tractor-trailers and other large vehicles.

Figure 6:
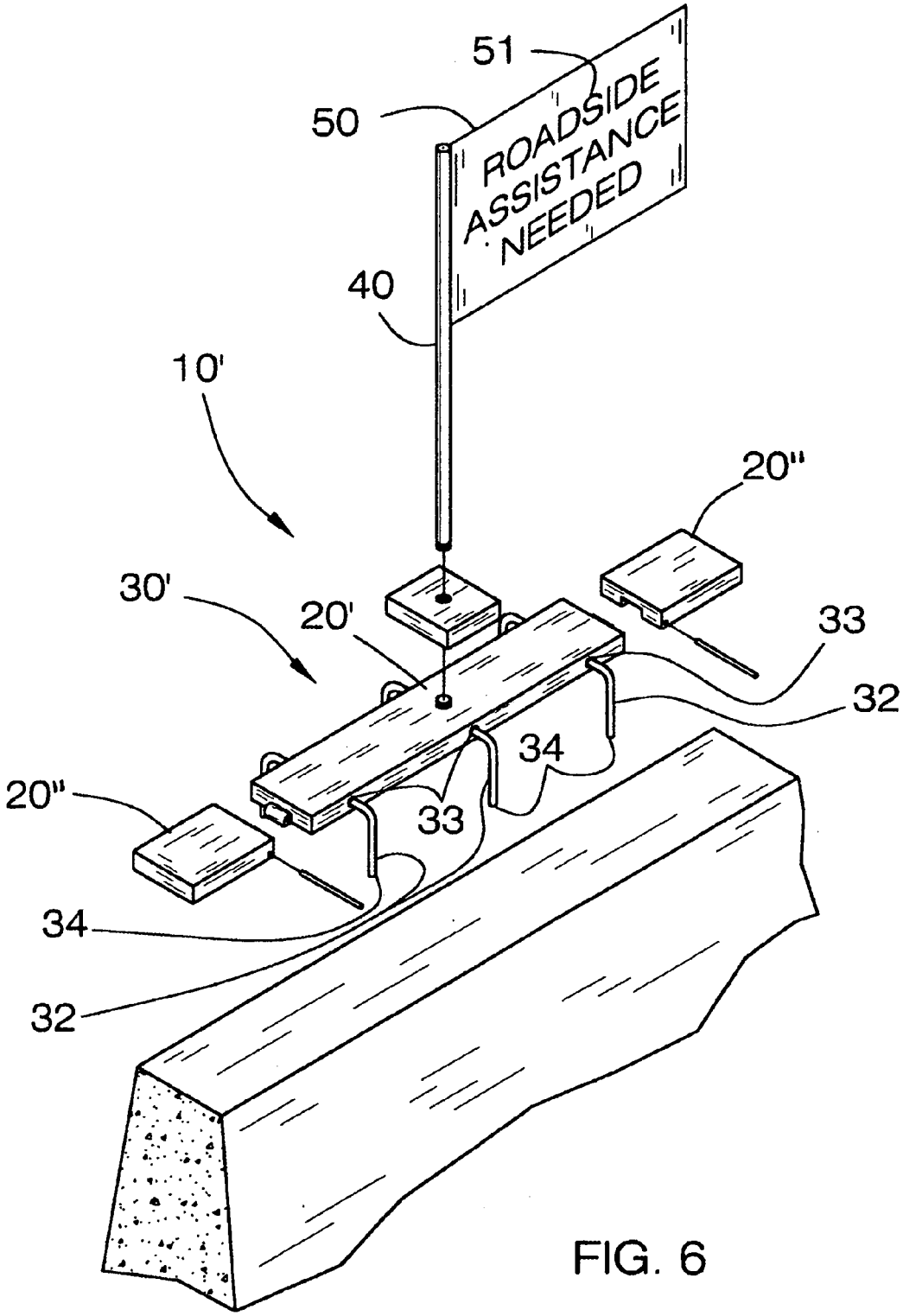
FIG. 6 is an exploded view showing an alternate embodiment of the present invention.
Figure 7:
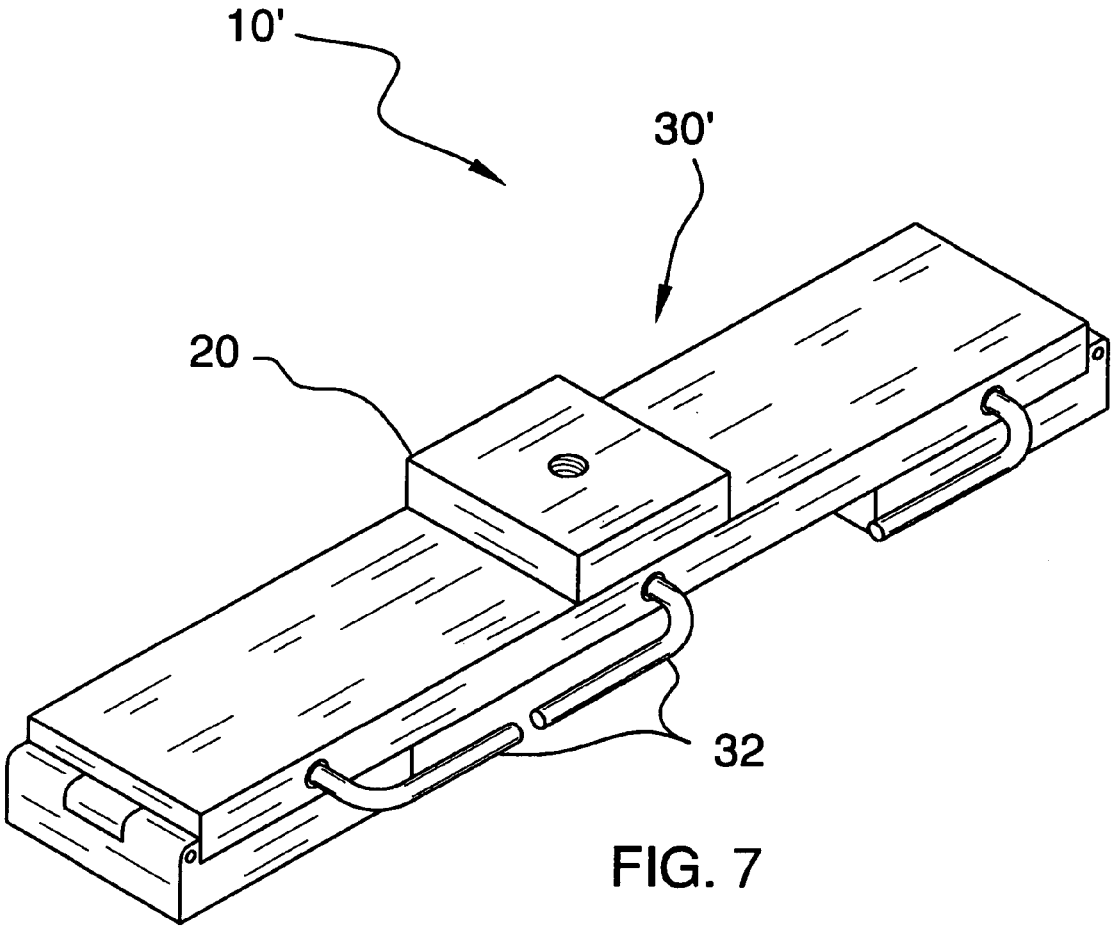
FIG. 7 is a perspective view showing the embodiment of FIG. 6 at a folded position.

Now referring to FIGS. 6 and 7, showing an alternate embodiment, the kit 10' further includes a mechanism 30' for fastening the base member 20 to a surface so that such a base member 20 can be maintained at a substantially secure position. Such a fastening mechanism 30' preferably includes an elongated anchor member 20' having a substantially rectangular shape and including a threaded fastening member extending upwardly therefrom and being securable to the base member 20.

The anchor member 20' further includes a plurality of arms 34 extending outwardly and downwardly from the edge 33 of the anchor member 20' and for gripping a support structure therebetween. Such a plurality of arms 32, 34 are pivotal between engaged and disengaged positions. A plurality of support members 20' are also pivotally connected to opposed end portions of the anchor member 20'. Such a plurality of support members 20' include a plurality of hinges connected thereto and for allowing the plurality of support members 20' to be moved between folded and extended positions. This allows a user to attach the kit 10' to a guardrail, concrete barrier, or sidewall near a stranded automobile, if so desired.

Referring back to FIGS. 2 and 3, the kit 10 further includes an elongated support member 40 having a lower end portion 41 threadably attachable to the base member 20. The elongated support member 40 extends substantially vertically and upwardly from the base member 20 to a predetermined height, and includes a receiving portion 42 extending substantially vertically along a length thereof and having a bottom surface 43, as perhaps best shown in FIG. 4.

Figure 4:
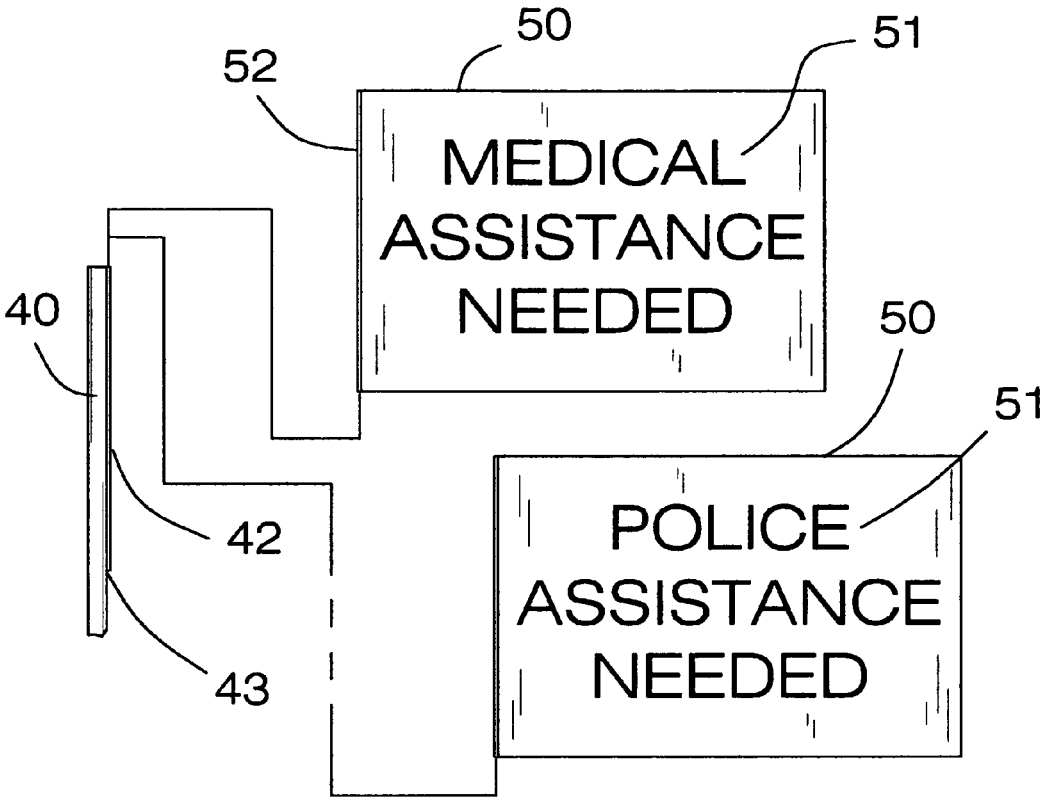
FIG. 4 is front elevational view showing a plurality of indicia attachable to the elongated support member.

Now referring to FIG. 4, the kit 10 further includes a flag 50 having indicia 51 printed thereon and including an edge portion 52 selectively engageable with the receiving portion 42. The indicia 51 may be formed in a variety of colors and shapes, and may further have a nearly endless variety of messages printed thereon. In addition to displaying roadside assistance messages, the flag 50 may display the colors and images of many different objects such as the name and logo of one's favorite sports team, for example. The receiving portion 42 is positionable on the bottom surface 43 thereof so that the flag 50 can be maintained in a substantially stable position. The edge portion 52 is positionable within the receiving portion 42 in a substantially vertical direction and substantially parallel to the axis 22.

Figure 5:
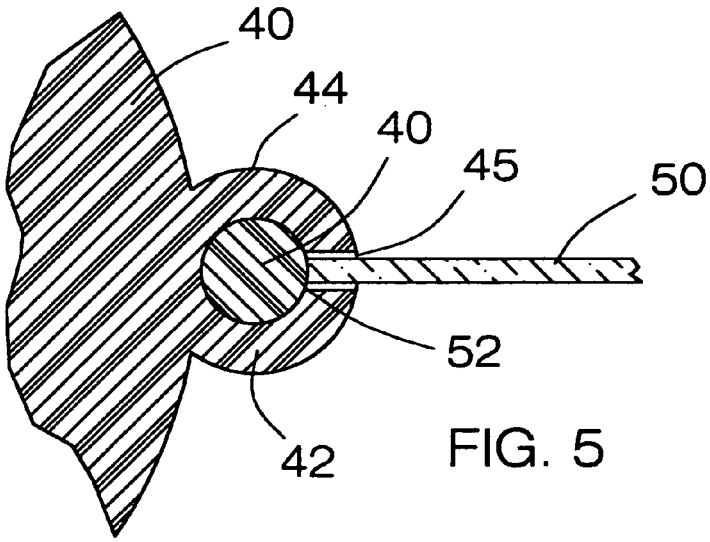
FIG. 5 is a cross-sectional view showing the receiving portion and groove for receiving a flag, taken along line 5—5.

Now referring to FIG. 5, the receiving portion 42 is integral with the support member 40 and extends outwardly therefrom, and further has a groove 45 for allowing the flag 50 to be selectively positioned along a length thereof. The receiving portion 42 further includes a plurality of arcuate portions 44 integral with the support member 40, which converges outwardly therefrom. This allows a user to quickly and easily change flags as conditions dictate. The flag 50 extends outwardly and away from the support member 40 when the edge portion 52 is disposed within the receiving portion 42, as perhaps best shown in FIG. 2.

Using the kit 10, a stranded motorist can easily and effectively summon assistance from passing motorists without causing excessive stops by motorists and further endangering others. The highly visible flag 50 would catch the attention of approaching drivers so that they could call for assistance. The kit 10 is weather-resistant, reusable, and adaptable to different situations and could help save a person's life in a medical emergency or eliminate extended stops along the roadside due to mechanical problems.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A vehicle alert kit comprising:

at least one base member having a substantially planar bottom surface for resting on a surface, said at least one base member having a centrally disposed axis traversing therethrough and further having a threaded opening centered about the axis;

means for fastening said at least one base member to a surface so that said at least one base member can be maintained at a substantially secure position;

an elongated support member having a lower end portion threadably attachable to a select one of said at least one base member, said elongated support member extending substantially vertically and upwardly from said at least one base member to a predetermined height, said elongated support member including a receiving portion extending substantially vertically along a length thereof and having a bottom surface; and a flag having indicia printed thereon and including an edge portion selectively engageable with said receiving portion and positionable on said bottom surface thereof so that said flag can be maintained in a substantially stable position, said edge portion being positionable within said receiving portion in a substantially vertical direction and substantially parallel to the axis;

wherein said means for fastening comprises an elongated anchor member having a substantially rectangular shape and including a threaded fastening member extending upwardly therefrom and being securable to said at least one base member, said anchor member further including a plurality of arms extending outwardly and downwardly from said anchor member and for gripping a support structure therebetween, said plurality of arms are pivotal between engaged and disengaged positions; and a plurality of support members pivotally connected to opposed end portions of said anchor member, said plurality of support members including a plurality of hinges connected thereto and for allowing said plurality of support members to be moved between folded and extended positions.

2. The vehicle alert kit of claim 1, wherein said receiving portion is integral with said elongated support member and extends outwardly therefrom, said receiving member having a groove for allowing said flag to be selectively positioned along a length thereof.

3. The vehicle alert kit of claim 1, wherein said flag extends outwardly and away from said elongated support member when said edge portion is disposed within said receiving portion.

4. The vehicle alert kit of claim 1, wherein said receiving portion comprises a plurality of arcuate portions integral with said elongated support member and converging outwardly therefrom.

5. A vehicle alert kit comprising:

at least one base member having a substantially planar bottom surface for resting on a surface, said at least one base member having a centrally disposed axis traversing therethrough and further having a threaded opening centered about the axis;

means for fastening said at least one base member to a surface so that said at least one base member can be maintained at a substantially secure position;

an elongated support member having a tower end portion threadably attachable to a select one of said at least one base member, said elongated support member extending substantially vertically and upwardly from said base member to a predetermined height, said elongated support member including a receiving portion extending substantially vertically along a length thereof and having a bottom surface; and a flag having indicia printed thereon and including an edge portion selectively engageable with said receiving portion and positionable on said bottom surface thereof so that said flag can be maintained in a substantially stable position, said edge portion being positionable within said receiving portion in a substantially vertical direction and substantially parallel to the axis;

said receiving portion being integral with said support member and extending outwardly therefrom, said receiving member having a groove for allowing said flag to be selectively positioned along a length thereof;

wherein said means for fastening comprises an elongated anchor member having a substantially rectangular shape and including a threaded fastening member extending upwardly therefrom and being securable to said at least one base member, said anchor member further including a plurality of arms extending outwardly and downwardly from said anchor member and for gripping a support structure therebetween, said plurality of arms are pivotal between engaged and disengaged positions; and a plurality of support members pivotally connected to opposed end portions of said anchor member, said plurality of support members including a plurality of hinges connected thereto and for allowing said plurality of support members to be moved between folded and extended positions.

6. The vehicle alert kit of claim 5, wherein said flag extends outwardly and away from said elongated support member when said edge portion is disposed within said receiving portion.

7. The vehicle alert kit of claim 5, wherein said receiving portion comprises a plurality of arcuate portions integral with said elongated support member and converging outwardly therefrom.

8. A vehicle alert kit comprising:

at least one base member having a substantially planar bottom surface for resting on a surface, said at least one base member having a centrally disposed axis traversing therethrough and further having a threaded opening centered about the axis;

means for fastening said at least one base member to a surface so that said at least one base member can be maintained at a substantially secure position;

an elongated support member having a lower end portion threadably attachable to a select one of said at least one base member, said elongated support member extending substantially vertically and upwardly from said base member to a predetermined height, said elongated support member including a receiving portion extending substantially vertically along a length thereof and having a bottom surface; and a flag having indicia printed thereon and including an edge portion selectively engageable with said receiving portion and positionable on said bottom surface thereof so that said flag can be maintained in a substantially stable position, said edge portion being positionable within said receiving portion in a substantially vertical direction and substantially parallel to the axis;

said receiving portion being integral with said support member and extending outwardly therefrom, said receiving member having a groove for allowing said flag to be selectively positioned along a length thereof, said receiving portion further including a plurality of arcuate portions integral with said support member and converging outwardly therefrom;

wherein said means for fastening comprises an elongated anchor member having a substantially rectangular shape and including a threaded fastening member extending upwardly therefrom and being securable to said at least one base member, said anchor member further including a plurality of arms extending outwardly and downwardly from said anchor member and for gripping support structure therebetween, said plurality of arms are pivotal between engaged and disengaged positions; and a plurality of support members pivotally connected to opposed end portions of said anchor member, said plurality of support members including a plurality of hinges connected thereto and for allowing said plurality of support members to be moved between folded and extended positions.

9. The vehicle alert kit of claim 8, wherein said flag extends outwardly and away from said elongated support member when said edge portion is disposed within said receiving portion.

* * * * *